US006963041B2

(12) United States Patent
Holsten

(10) Patent No.: US 6,963,041 B2
(45) Date of Patent: Nov. 8, 2005

(54) SWITCH ACTUATOR ASSEMBLY

(75) Inventor: Stuart V. Holsten, O'Fallon, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/707,880

(22) Filed: Jan. 20, 2004

(65) Prior Publication Data

US 2005/0155850 A1 Jul. 21, 2005

(51) Int. Cl.[7] ..... H01H 13/00
(52) U.S. Cl. ..... 200/339; 200/553; 200/329
(58) Field of Search ..... 200/339, 329, 200/330–334, 293, 294, 295, 553, 17 R

(56) References Cited

U.S. PATENT DOCUMENTS 4,221,941 A * 9/1980 Genovese ..... 200/457
4,230,917 A * 10/1980 Osika ..... 200/43.01
4,861,950 A * 8/1989 Yanai et al. ..... 200/5 R
5,213,204 A * 5/1993 Sommer ..... 200/303
5,285,039 A * 2/1994 Satoh ..... 200/563
6,710,274 B2 * 3/2004 Whetzel et al. ..... 200/330
6,720,512 B1 * 4/2004 Rothbauer et al. ..... 200/330

* cited by examiner

*Primary Examiner*—Richard K. Lee
(74) *Attorney, Agent, or Firm*—Locke Liddell & Sapp LLP

(57) ABSTRACT

A switch assembly includes a switch having an actuator extending from a base that is movable between first and second switch positions. A housing defines an opening in which the switch is seated. A pivot member extends from the control member and is received by a socket defined in the housing such that the control member is movable on the pivot member between first and second controller positions. A contact member extends from the control member so that movement of the control member between the first and second controller positions moves the actuator between the first and second switch positions.

21 Claims, 4 Drawing Sheets

SWITCH ACTUATOR ASSEMBLY

BACKGROUND

1. Field of the Disclosure

This disclosure relates generally to switches, and more particularly, to a switch assembly for actuating a switch such as a toggle switch.

2. Description of Related Art

Appliances typically include a switch for turning the appliance on or off as desired by a user. Toggle or rocker switches are often used for this purpose, wherein an actuating member is positioned in an "on" or "off" position. Three-position switches are also employed, for example, to provide for forward, reverse, and off positions.

When such switches are used on appliances such as wet/dry vacuums, the switches may be exposed to moisture and dust. Thus, it may be desirable to protect the switch from such environments. Further, the rocker actuator on typical rocker switches is often relatively small, making it difficult to locate and operate, for example, if the user is wearing work gloves. Similarly, the actuator stem on toggle switches may also be difficult to locate and operate.

Rather than use a switch having a large native actuating member, switch actuator assemblies may be added to the switch to provide a larger actuator and/or to protect the switch and actuator. Known switch actuator assemblies, however, add undesirable complexity and cost to the appliances upon which they are employed. For example, prior art actuator assemblies are often comprised of multiple parts and require complicated manufacturing procedures to attach the assembly to the appliance.

The present application addresses shortcomings associated with the prior art.

SUMMARY

Among other things, this disclosure concerns a switch assembly that may be used in an appliance such as a wet/dry vacuum. A switch having an actuator connected to a base is provided, for example, to turn the appliance on or off. Accordingly, the actuator is movable between first and second, or "on" and "off" switch positions. The switch may include further positions as necessary. Different types of switches may be used, such as a toggle switch, rocker switch, push button switch, etc. A housing defines an opening in which the switch base is seated. A control member is pivotally received by the housing. More particularly, a pivot member extending from the control member is received by a socket defined in the housing such that the control member is movable on the pivot member between first and second controller positions. A contact member extends from the control member such that movement of the control member between the first and second controller positions moves the actuator between the first and second switch positions.

Exemplary embodiments disclosed herein may include first and second shoulders defined on either side of the pivot member. The housing defines corresponding first and second ledges on either side of the socket so that the first shoulder and the first ledge contact each other when the control member is in the first position and the second shoulder and the second ledge contact each other when the control member is in the second position. Such an arrangement provides protection for the switch by transferring at least some of the force of a blow to the housing, rather than the switch itself.

BRIEF DESCRIPTION OF DRAWINGS

Other objects and advantages of the invention will become apparent upon reading the following detailed description and upon reference to the drawings in which.

Figure 1:
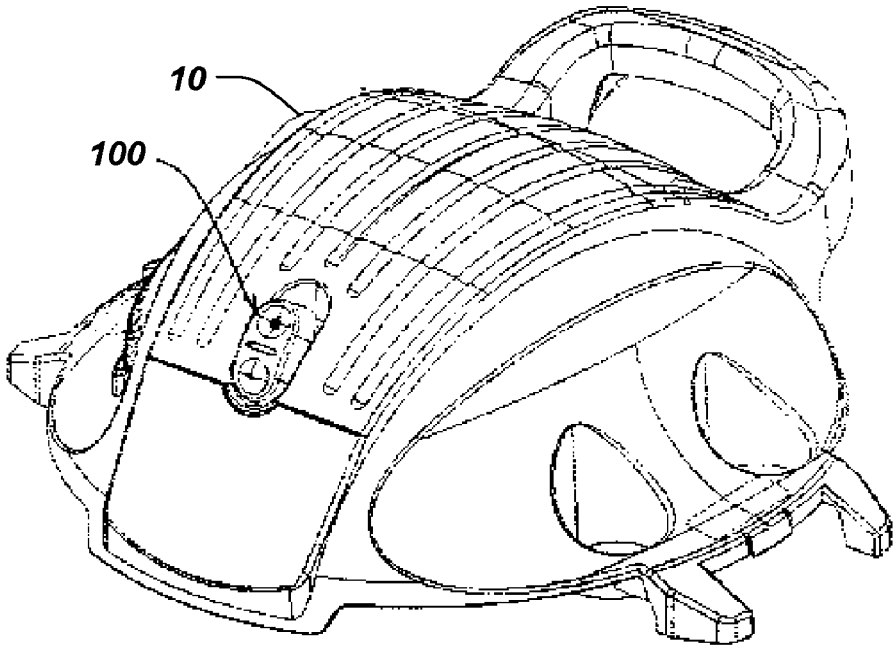
FIG. 1 is a perspective view of the motor cover assembly of a wet/dry vacuum employing a switch assembly in accordance with the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
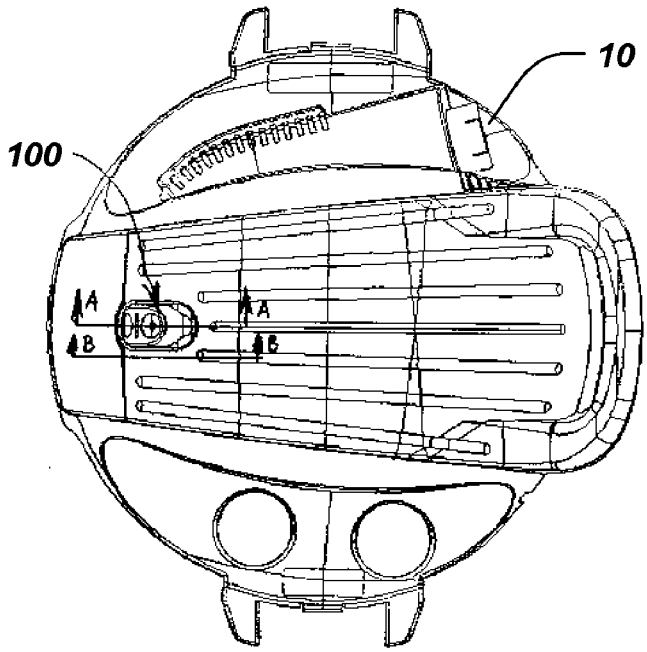
FIG. 2 is a top view of the wet/dry vacuum motor cover showing the switch assembly.

FIGS. 1 and 2 show the motor cover of a wet/dry vacuum appliance 10 employing an exemplary switch assembly 100 in accordance with aspects of the present invention. For purposes of disclosure, the switch assembly 100 is shown as implemented in the wet/dry vacuum appliance 10, though the switch assembly 100 could be used in any appliance requiring an operation switch. In the illustrated embodiment, the switch assembly is used to turn the wet/ dry vacuum appliance 10 on and off, though the switch assembly also may be used for switching between more than two positions, such as a three position switch.

Figure 3A:
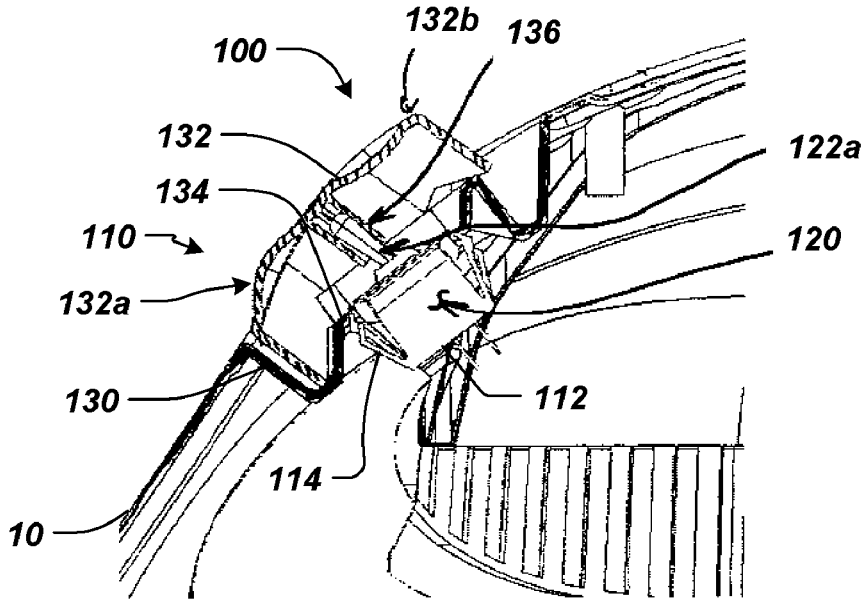
FIGS. 3A–3C are sectional side views of alternative embodiments of the switch assembly.
Figure 8:
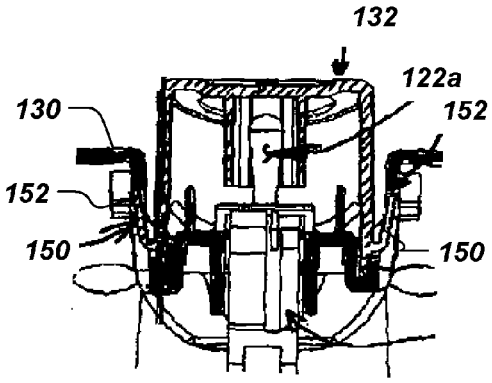
FIG. 8 is a sectional end view of the control member received in the housing of the switch assembly.

FIG. 3A is a section view of the switch assembly 100 taken along line A—A of FIG. 2. The switch assembly includes a switch controller 110 that operates the actuator of a switch 112. In the exemplary embodiment shown in FIG. 3A, the switch 112 is a toggle switch that includes a base 120 having an actuation stem 122*a* extending therefrom. The stem 122*a* is pivotal between first and second positions, for example, "on" and "off" positions. In other embodiments, the switch 112 may include three or more positions, such as "off," "high" and "low." The switch controller 110 includes a housing 130 and a control member 132 that are snap-fit together, providing simple and efficient assembly thereof. The switch base 120 is seated in an opening 134 in the bottom of the housing 130. In the illustrated embodiment, the switch 112 includes flexible tabs 114 that lock the switch 112 into the housing 130. A contact member 136 extends from the underside of the control member 132 to move the actuation stem 122*a*. In the illustrated embodiment employing a toggle switch, the contact member 136 is a rigid sleeve that receives the actuation stem 122*a*. The sleeve may be integrally formed with the control member 132, and as shown in FIG. 8, may be shaped to allow it to flex as necessary to accommodate varying sizes of actuation stems 122*a*.

Figure 3B:
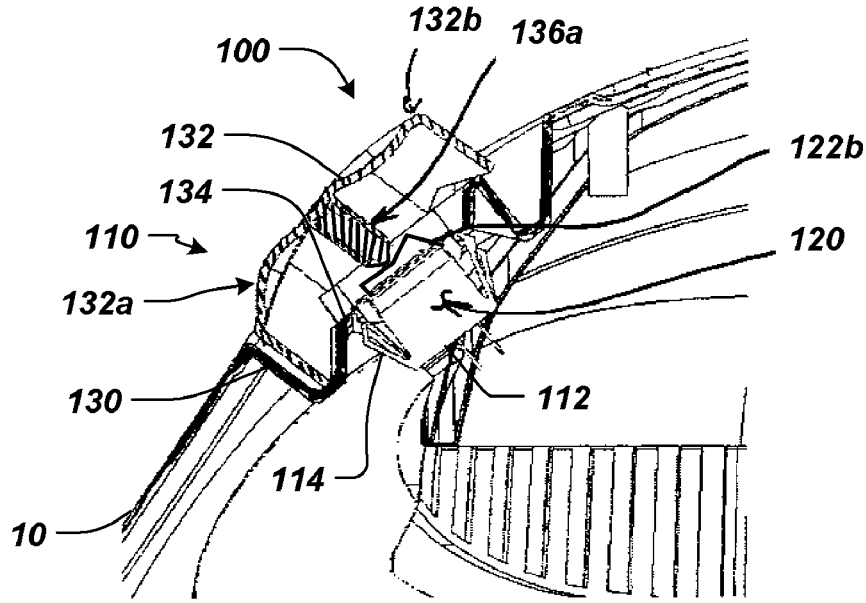
Figure 3C:
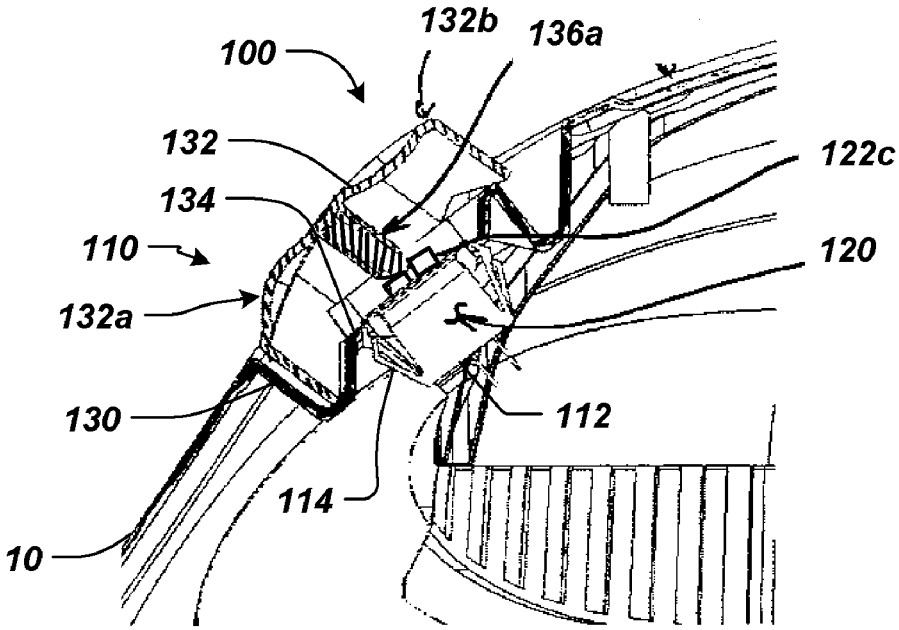

FIG. 3B illustrates an alternative embodiment, wherein the switch 120 is a rocker switch having a rocker 122*b* for the actuator. In this embodiment, the contact member 136*a* contacts first or second actuation surfaces of the rocker 122*b* when the control member 132 is in first or second positions. In FIG. 3C, another alternative embodiment is shown, in which the switch 120 is a push button switch having two or more push buttons 122*c* extending from the base of the switch 120. The contact member 136*a* contacts one of the push buttons 122*c* when the control member 132 is in one position, and contacts the other push button 122*c* when the control member 132 is in the other position.

Figure 4:
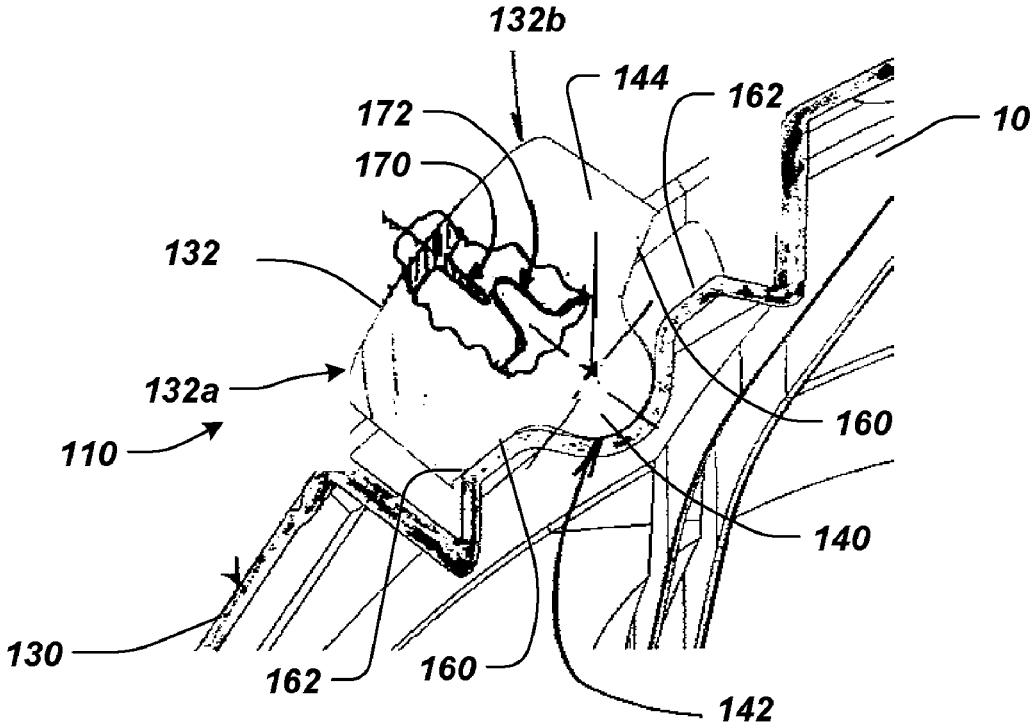
FIG. 4 is another sectional side view of the switch assembly.
Figure 5:
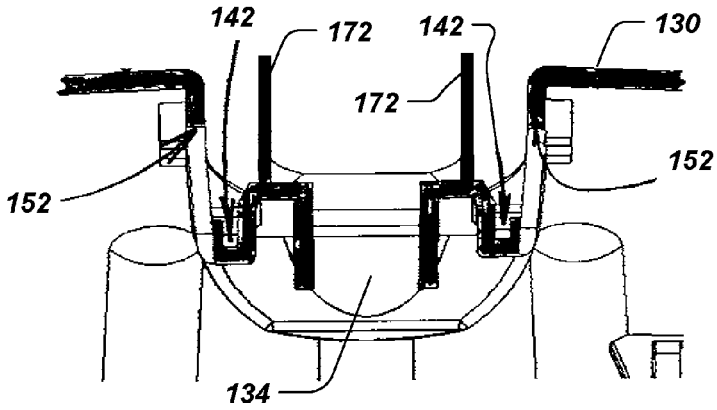
FIG. 5 is a sectional end view of a housing of the switch assembly.

FIG. 4 is a section view of the switch assembly 100 taken along line B—B of FIG. 2. FIG. 5 is a sectional view illustrating portions of the housing 130 and FIGS. 6–9 show various views of the control member 132. The control member 132 pivots in the housing 130 to selectively move the actuator between its first and second positions. At least one pivot member 140 extends from the control member 130 and is received by a corresponding socket 142 defined in the housing 130. In the exemplary illustrated embodiment, the control member 130 defines a pair of pivot members 140 received by a pair of corresponding sockets 142 formed in the housing 130.

Figure 6:
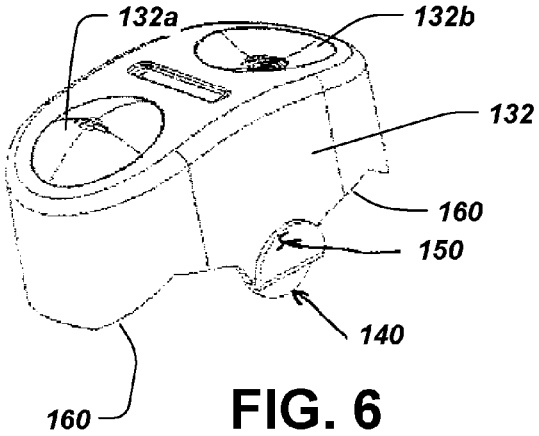
FIG. 6 is a perspective view of a control member of the switch assembly.
Figure 7:
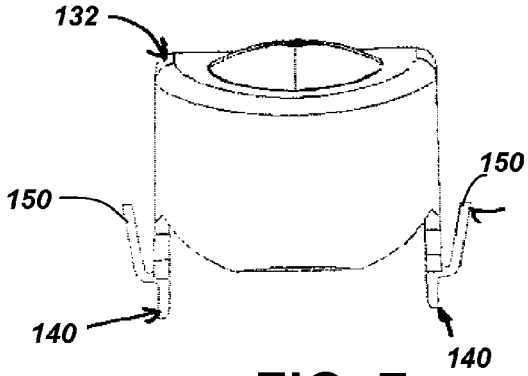
FIG. 7 is an end view of the control member of the switch assembly.

A locking tab 150 extends from the pivot member 140 (best seen in FIGS. 6 and 7). In the illustrated embodiment, each of the pivot members 140 define a flexible locking tab 150 extending therefrom. The housing 130 defines corresponding openings 152 therein. As shown in FIG. 8, the openings 152 receive the locking tabs 150 when the control member 132 is seated in the housing 130, thus locking the two pieces together. In certain embodiments, the tabs 150 are sized differently, so that the openings 152 will only receive the corresponding tabs 150 when the control member 132 is inserted in the proper orientation.

The control member 132 defines an "on" end 132*a* and an "off" end 132*b*, which extend from, and recess into, the control member 132, respectively, to provide a tactile indication of the switch assembly functions. In FIGS. 3 and 4, the control member 132 is shown situated in the "on" position, with the "on" end 132*a* pushed down into the housing 130. In this position, the actuator is in its corresponding "on" position (to the left as shown in the drawings). To turn the appliance 10 off, a user pushes the "off" end 132*b*. As shown, for example, in FIG. 4, the pivot members 140 pivot in the sockets 142 about an axis 144, which is generally situated on the pivot axis of the actuation stem 122*a* of the toggle switch 112, resulting in moving the actuation stem 122*a* to its "off" position (to the right as shown in the drawings).

The control member 132 has shoulders 160 on either side of the pivot member 140, and corresponding ledges 162 are defined on either side of the socket 142 in the housing 130. As shown in FIGS. 3 and 4, the shoulder 160 and corresponding ledge 162 on the "on" end of the control member 132 contact each other when the control member 132 is in the "on" position illustrated. When the control member 132 is moved to the "off" position, the opposite shoulder 160 and ledge 162 would then contact each other. In this manner, the switch control assembly 110 protects the switch 112 from damage resulting from imparts to the appliance 10 in the area of the switch assembly 100. For example, if the an object falls onto the control member 132 in the direction of the "off" end 132*b*, the force of the impact is transferred from the control member 132 to the housing 130 when the shoulder 160 and ledge 162 contact each other. Absent the assembly 110, the object would directly impact the switch 112, possibly resulting in damaging the actuator.

Figure 9:
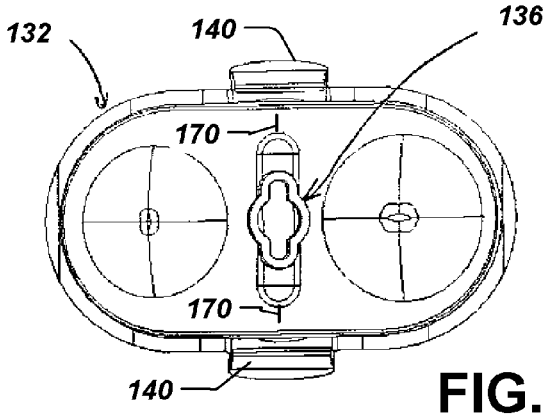
FIG. 9 is a bottom view of the control member of the switch assembly.

Some embodiments include further structure to make the two switch positions even more distinct. FIG. 9 shows the underside of the control member 132. Flexible tabs 170 extend from the control member 132, situated on either side of the contact member 136. These flexible tabs 170 interact with projections 172 extending from the housing 130, shown in FIGS. 4 and 5. Both the tabs 170 and the projections 172 may be integrally molded with the control member 132 and housing 130, respectively. When the control member 132 is in the position shown in FIGS. 3 and 4, the flexible tabs 170 will be located on the left side of the projections 172. When the "off" end 132*b* of the control member 132 is depressed, the control member 132 will pivot about the axis 144. The flexible tabs 170 will contact the projections 172 as the control member 132 pivots until the tabs 170 flex and pass over the projections 172 and snap into place on the opposite side of the projections 172, positively situating the control member 132 in the "off" position.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A switch assembly, comprising:

a switch having an actuator attached to a base, the actuator having first and second switch positions;

a housing defining an opening therein, the base being seated in the opening, the housing defining first and second ledges;

a control member received by the housing, the control member defining first and second shoulders;

a pivot member extending from the control member and received by a socket defined in the housing such that the control member is movable on the pivot member between first and second controller positions, wherein the first shoulder and the first ledge contact each other when the control member is in the first position; and a contact member extending from the control member such that in response to movement of the control member between the first and second controller positions, the contact member moves the actuator between the first and second switch positions.

2. The switch assembly of claim 1, wherein the second shoulder and the second ledge contact each other when the control member is in the second position.

3. The switch assembly of claim 1, wherein the pivot member comprises first and second pivot members.

4. The switch assembly of claim 1, further comprising:

a flexible tab extending from the control member;

a projection extending from the housing;

wherein the flexible tab is situated on one side of the projection when the control member is in the first position, and when the control member is moved to the second position, the flexible tab slides over the projection and situates on the other side of the projection to positively locate the control member.

5. The switch assembly of claim 4, wherein the flexible tab is integrally formed with the control member.

6. The switch assembly of claim 1, wherein the switch defines a locking tab extending therefrom, the locking tab interacting with the opening in the housing to lock the switch into the housing.

7. The switch assembly of claim 1, wherein:

the switch comprises a toggle switch;

the actuator comprises a stem extending from a base of the toggle switch; and the contact member comprises a rigid sleeve receiving the stem.

8. The switch assembly of claim 1, wherein:

the switch comprises a rocker switch;

the actuator comprises a rocker having first and second actuation surfaces; and the contact member comprises a rigid member contacting the first actuation surface when the control member is in the first controller position and contacting the second actuation surface when the control member is in the second controller position.

9. The switch assembly of claim 1, wherein:

the switch comprises a push button switch;

the actuator comprises first and second push buttons extending from a base of the push button switch; and the contact member comprises a rigid member contacting the first push button when the control member is in the first controller position and contacting the second push button when the control member is in the second controller position.

10. The switch assembly of claim 1, wherein the pivot member includes a locking tab extending therefrom received by a corresponding locking opening in the housing to lock the control member to the housing.

11. A switch controller assembly, comprising:

a control member having a contact member extending therefrom for actuating a switch actuator;

a pivot member extending from the control member;

a locking tab extending from the pivot member;

a housing receiving the locking tab of the pivot member to lock the control member into the housing such that the control member is movable on the pivot member between first and second positions.

12. The switch controller assembly of claim 11, wherein the pivot member comprises first and second pivot members.

13. The switch controller assembly of claim 11, wherein the housing defines an opening therein for receiving the locking tab.

14. The switch controller assembly of claim 11, further comprising:

a flexible tab extending from the control member;

a projection extending from the housing;

wherein the flexible tab is situated on one side of the projection when the control member is in the first position, and when the control member is moved to the second position, the flexible tab slides over the projection and situates on the other side of the projection to positively locate the control member.

15. The switch controller assembly of claim 11, wherein the contact member comprises a rigid sleeve for receiving a stem of a toggle switch.

16. A method of actuating a switch, comprising:

situating a switch in a housing, the switch having an actuator with first and second switch positions;

placing a control member having first and second ends into the housing, wherein placing the control member includes:

seating a pivot member extending from a control member into a socket defined in the housing such that the control member is movable on the pivot member between first and second controller positions; and inserting a locking tab extending from the pivot member into a corresponding locking opening in the housing to lock the control member to the housing; and depressing the second end of the control member to pivot the control member on the pivot member such that a contact member extending from the control member moves the actuator from the first switch position to the second switch position.

17. The method of claim 16, further comprising depressing the first end of the control member to move the actuator from the second switch position to the first switch position.

18. The method of claim 16, wherein depressing the second end of the control member to move the actuator from the second switch position to the first switch position includes contacting a first shoulder adjacent the pivot member with a first ledge adjacent the socket.

19. The method of claim 16, wherein the actuator comprises a stem extending from a base of the switch, and wherein placing the control member includes sliding the stem into a sleeve extending from the control member.

20. A switch assembly, comprising:

a switch having an actuator attached to a base the actuator having first and second switch positions;

a housing defining an opening therein, the base being seated in the opening;

a projection extending from the housing;

a control member received by the housing;

a flexible tab extending from the control member;

a pivot member extending from the control member and received by a socket defined in the housing such that the control member is movable on the pivot member between first and second controller positions, wherein the flexible tab is situated on one side of the projection when the control member is in the first position, and when the control member is moved to the second position, the flexible tab slides over the projection and situates on the other side of the projection to positively locate the control member; and a contact member extending from the control member such that in response to movement of the control member between the first and second controller positions, the contact member moves the actuator between the first and second switch positions.

21. The switch assembly of claim 20, wherein the flexible tab is integrally formed with the control member.

* * * * *